United States Patent [19]

Sarfati

[11] Patent Number: 4,708,299

[45] Date of Patent: Nov. 24, 1987

[54] THREAD DELIVERY DEVICE

[75] Inventor: Alberto G. Sarfati, Como, Italy

[73] Assignee: SOBREVIN Societe de brevets industriels-Etablissement, Liechtenstein

[21] Appl. No.: 887,274

[22] Filed: Jul. 21, 1986

[30] Foreign Application Priority Data

Aug. 10, 1985 [DE] Fed. Rep. of Germany ..... 3528816

[51] Int. Cl.[4] ..... B65H 51/22

[52] U.S. Cl. ..... 242/47.01; 242/47.12

[58] Field of Search ..... 242/47.01, 47.12, 47.04, 242/47.05, 47.08, 47.09, 47.1, 47.11, 47; 139/452; 66/132 R

[56] References Cited

U.S. PATENT DOCUMENTS

| | | | |
|---|---|---|---|
| 3,625,444 | 12/1971 | Hatay | 242/47.12 X |
| 3,759,300 | 9/1973 | Pfarrwaller | 242/47.12 X |
| 3,791,598 | 2/1974 | Vischiani et al. | 242/47.12 |
| 3,796,386 | 3/1974 | Tannert | 242/47.12 |
| 3,921,925 | 11/1975 | Sarfati et al. | 242/47.12 |
| 3,971,522 | 7/1976 | Pfarrwaller | 242/47.01 |
| 4,090,677 | 5/1978 | Savio et al. | 242/47.01 |
| 4,235,388 | 11/1980 | Jacobsson | 242/47.12 X |
| 4,349,161 | 9/1982 | Carlsson et al. | 242/47.12 X |
| 4,383,655 | 5/1983 | Ahrendt et al. | 242/47.12 X |

FOREIGN PATENT DOCUMENTS

| | | |
|---|---|---|
| 2003760 | 8/1971 | Fed. Rep. of Germany . |
| 2035754 | 1/1972 | Fed. Rep. of Germany . |
| 641119 | 2/1984 | Switzerland . |

*Primary Examiner*—Stanley N. Gilreath

*Attorney, Agent, or Firm*—Wood, Herron & Evans

[57] ABSTRACT

A thread-delivery device is disclosed including a storge body formed by bars disposed in the shape of a polygon. The bars form two axially-spaced sections of approximately equal circumferential length. A cylindrical member having sawtooth-shaped threading grooves is rotated between the bars of the first section. The bottom of the threading grooves is located radially inwardly of lines interconnecting the bars. A ring having a conical face is disposed at the thread entrance opening adjacent to one end of the first section and a sensing device is provided to sense the endmost thread wound on the second section.

7 Claims, 4 Drawing Figures

THREAD DELIVERY DEVICE

BACKGROUND OF THE INVENTION

The invention concerns thread-delivery devices of the type including a storage body comprising two axially-spaced sections. The first section is formed by bars forming a polygon around which thread is looped tangentially. The looped thread is advanced from the first section to a second section by a member having grooves. Thread is subsequently removed from the second section and is delivered to a machine, such as a weaving machine.

In prior devices of this type (see, for example, Swiss Patent Document No. 641 119), thread is advanced by means of threading grooves having face areas formed by spindles which are disposed in the space between two polygonal bars in such a way that the bottom of the threading grooves forms part of the polygon. Consequently, the entering thread is supported both by the polygonal bars and by the bottom of the respective threading groove and is configurated in polygonal form. Such thread-delivery devices are unsuited as a practical matter for installations in which the primary concern is making a thread available for uniformly tensioned withdrawal at high speed, for instance, for insertion in the weft compartment of a weaving machine. The reason for this is that the circumferential length of the second section onto which the thread windings are transferred pending their withdrawal is smaller than that of the first section where the thread loops formed by the threading grooves are of necessity of a circumferential length sufficient to pass around the individual bars of the polygon. Any considerable difference in the circumferential length of the first section from the circumferential length of the second section precludes extensive transfer of thread windings from the first section to the second section and their transport forward from the rear, while retaining the existing order of thread windings.

One different form of delivery device for weft threads, or the like, which provides an orderly arrangement of thread windings is disclosed in German patent document No. 2,035,754. However, an orderly arrangement of the thread windings side-by-side on the second section in a thread-delivery device of the type shown in Swiss Pat. No. 641,119 can be accomplished only to the extent that the thread windings slide due to sufficient inclination of the polygon bars toward the front end, i.e., due to the truncated cone-shaped extension of the polygon bars on the second section increasing considerably further the excess length of each thread winding relative to the circumferential length of the polygon bars. But this limits the use of such thread-feeding devices to applications where the thread is continually delivered in a loose form, for instance, for subjecting the yarn later to specific yarn treatments, such as vaporization. Moreover, the storage, arrangement and drive of the spindles arranged between polygonal bars is very expensive and leads to a design which is susceptible to malfunction. Furthermore, it is difficult to incorporate the thread windings which are still contained on the first section into the available thread supply.

In other thread-delivery devices which are geared to withdrawing the thread overhead, for instance, for feeding to circular knitting machines and looms (see German patent disclosure No. 2,003,760), a central cylindrical threaded body is combined with a rotatably mounted fork body; the bottom of the threading grooves of the central body and the outside surface of the fork prongs of the rotatable fork body form a polygon around which the thread is looped. There is no transfer of thread from a first section to a second section. In such devices, the achievable looped thread supplies are relatively small, limiting the application to withdrawing machines which always require only relatively short thread lengths.

SUMMARY OF THE INVENTION

The present invention is directed to a thread-delivery machine of a simplified and dependable construction which will make relatively large thread supply amounts available for abrupt withdrawal at constant tension.

The present invention is predicated upon the concept of providing a thread-delivery device including a storage body having first and second sections in axial alignment. The storage sections comprise a plurality of axially-extending bars defining a polygon for receiving loops of thread, the circumference of the first and second sections being equal.

The thread-delivery device further comprises a member configurated to form peripheral threading grooves intermediate the bars, the grooves including a bottom portion located radially inwardly of the bars and a front face for advancing the thread toward said second section. A sensing device is mounted for sensing the endwise thread winding on the second section for controlling thread feed onto the first section. In a preferred embodiment, the grooves are of sawtooth shape in longitudinal section and include a face extending at an incline toward the second section. In the preferred embodiment, the grooves are formed as a helix on the surface of a cylindrical member which rotates between the bars.

It has further been found advantageous to provide a step formed on the outer portion of the bars adjacent to the midpoint of the length of the cylindrical member. In the preferred embodiment, the bars are connected to a ring adjacent to the thread feed opening which ring has a conic surface in the plane of the thread feed opening and a front face adjacent to the front face of a groove in the cylindrical member.

One advantage of the present threaddelivery device is that it is dependable in operation and is relatively inexpensive. Moreover, the thread-delivery device provides a large amount of thread supply for withdrawal at constant tension by a consuming machine, for instance, a weaving machine. This is accomplished by transferring thread loops, while retaining the orderly arrangement of the windings from the first section to the second section where they are then pushed forward closely side-by-side from the rear. The last front face of the winding groove exerts a pushing effect on the first winding on the second section. The similarity of the circumferential length between the first section and the second section ensures that the thread layers will not ride above one another on the second section due to circumferential loosening. Thus, an initial sequence of the thread loops is established on the first section which is retained until withdrawal, the only difference being that on the second section the thread windings are situated closer together than on the first section. Additionally, the amount of supply available is larger because those thread windings which are still contained on the first section in the threading grooves are also available for withdrawal.

The present device can also make available considerably larger thread lengths for withdrawal because the thread-delivery to the first section can take place at a speed considerably higher than with other devices where the thread is advanced from the entrance, without any special ordering, and is laid winding-on-winding. The rotary body preferably rotates simultaneously with the winding of the thread. Providing only a single rotary body which is coordinated with the polygon bars results in a considerable simplification of the delivery device and its drive. Depending on the number of polygon bars, a corresponding number of front face sections becomes effective, ensuring a reliable advance of the thread windings.

The sawtooth-type cross-section of the threading grooves facilitates removal of the thread windings from the first section. The vertical face of the groove is perpendicular to the longitudinal axis of the rotary body, whereas the rear flank has an appropriate angle of inclination. To facilitate the advance of the looped supply contained in the area of the rotary body, a sliding step for the thread is provided at the midpoint of the length of the cylindrical section on the outside of the polygon bars. This step permits a certain equalization of tension, specifically with elastic threads.

The winding of the thread in the area of the thread entrance point is assisted by joining the ends of the polygon bars on the near side of the thread entrance point to a ring. This ring forms a sliding surface which, in the thread entrance plane, has the shape of a truncated cone. The thread proceeds to this sliding surface from the thread eyelet. Next, the thread runs past the front face of the ring, which front face is approximately in alignment with the front face section of the groove which is located in the area of the thread entrance point. Thus, the thread is dependably placed in the beginning area of the threading groove.

An embodiment of the invention will be explained hereafter with the aid of FIGS. 1–4.

DESCRIPTION OF A PREFERRED EMBODIMENT

Figure 1:
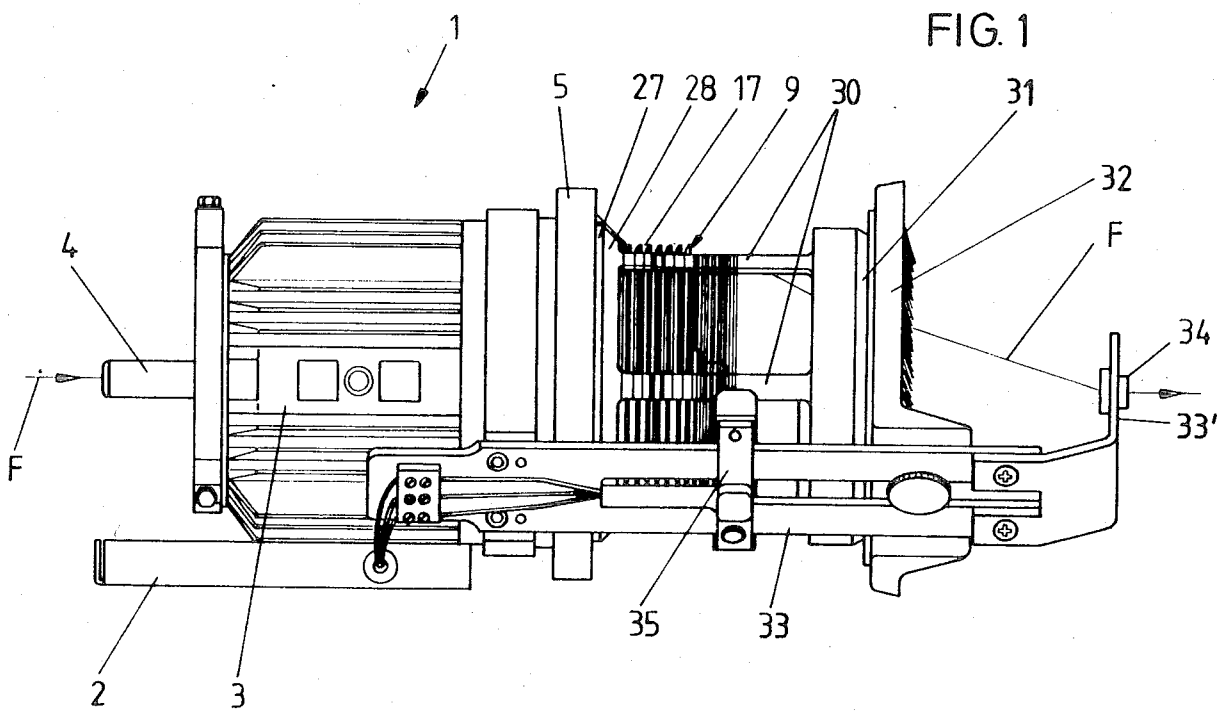
FIG. 1 is a side elevational view of a delivery device embodying the present invention.
Figure 2:
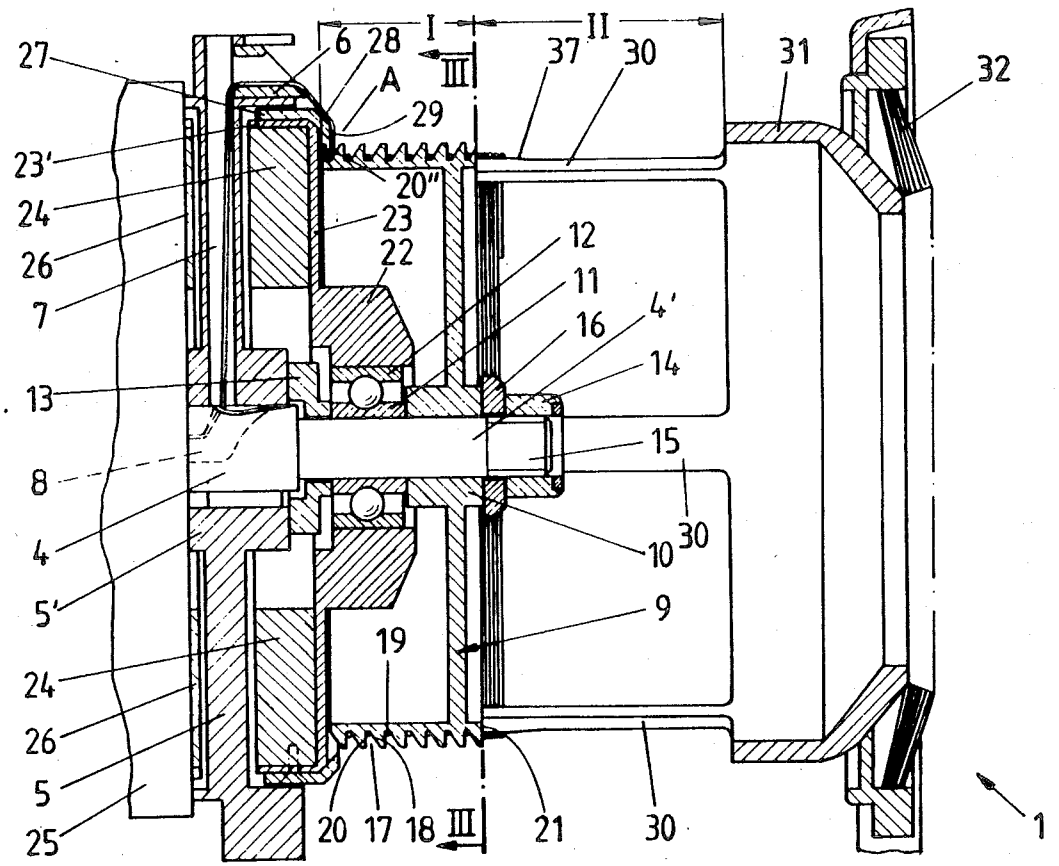
FIG. 2 is a longitudinal sectional view, approximately actual size, through the delivery device in the area of the storage body.

The delivery device comprises a support plate 2 on which an electrical motor 3 is mounted. the motor shaft 4 supports on one of its ends a keyed disc 5 which includes a thread eyelet 6 on its outer edge. The thread eyelet 6 extends into a radial channel 7 of the disc 5, which radial channel connects with a center bore 8 in the motor shaft 4.

A rotary body 9 is mounted on an offset section 4' of the motor shaft 4. This rotary body comprises a hub 10 through which the intermediary of an inner face 11 of an antifriction bearing 12 and a spacer ring 13 bears on the hub 5' of the disc 5. The tightening on the hub 5' is effected by a nut 14 which is screwed on the outside threading 15 of the end section 4' of the motor shaft 4, with a washer 16 in between. This causes the rotary body 9 to rotate together with the winding device comprised of the thread eyelet 6 and the disc 5.

The cylindrical surface of rotary body 9 is provided with threading grooves 17 in the form of a continuous helix. Viewed in longitudinal section, these grooves have a sawtooth shape. The rear face 18 of each groove, facing toward the thread entrance point A, extends toward the free end and outward at an inclination from a short thread bottom 19 which extends parallel to the motor shaft 4. In addition, each threading groove 17 comprises a front face 20 which is perpendicular to the motor shaft 4 and faces away from the thread entrance point A. This front face extends into the front face 21 of the rotary body 9 facing away from the thread entrance point A.

The antifriction bearing 12 is accommodated in a hub 22 of a support disc 23. Said disc is cup-shaped and houses permanent magnets 24 in its inside space facing toward the disc 5; these magnets interact with permanent magnets 26 which are contained in the electric motor housing 25. This prevents the support disc 23 from revolving along with the motor shaft 4. The support disc 23 nests in the disc 5 and its cylindrical wall 23' is surrounded by a ring 27 which is permanently connected with the cylindrical wall 23'. The ring 27 includes a sliding surface 28 which has the shape of a truncated cone. Surface 28 is disposed forwardly of thread eyelet 6 and terminates in a front face 9. Situated on the same radial plane as the thread entrance point A, the adjacent front face section 20'' of the front groove face 20 is approximately in alignment with the front face 29 of the ring 27. Six bars 30 are connected to the front face 29 of the ring 27. Bars 30 are disposed in an even angular distribution to form a polygon and in their opposite ends are joined to a withdrawal cup 31. A damping ring 32, the construction of which is well known in the art, cooperates with cup 31. The damping ring is carried by support 33 which is, in turn, connected with the electric motor housing 25. The free angled end 33' of the support 33 includes thread withdrawal eyelet 34. The polygon bars extend in a straight line and preferably also parallel to one another from the ring 27 to the withdrawal end.

A photoelectric relay 35, which functions as a sensing device, is mounted upon support 33. This relay can be adjusted parallel to the longitudinal axis of the storage body formed by the individual bars 30. Damping ring 32 can likewise be adjustably positioned to control the location of the thread entrance.

The front face 20 of the rotary body 9 protrudes in radial direction beyond the connecting straight line of the polygonal corners formed by the polygon bars 30. The front face 20 of the threadreceiving groove 17, which is located between two adjacent individual bars 30, thus forms thrust surface 20'. The bottom 19 of the threading groove 17 is located radially inward from the connecting straight line. A small sliding step 36 is located at the midpoint of the length of the cylindrical section on the outside of the individual bars 30. Another small sliding step 37, on the polygon bars 30, is disposed in the area between the front face 21 of the rotary body 9 and the withdrawal cup 31. These steps have practically no effect on the overall circumferential length of the polygon storage body. This length equals on the first section I that of the second section II.

Figure 3:
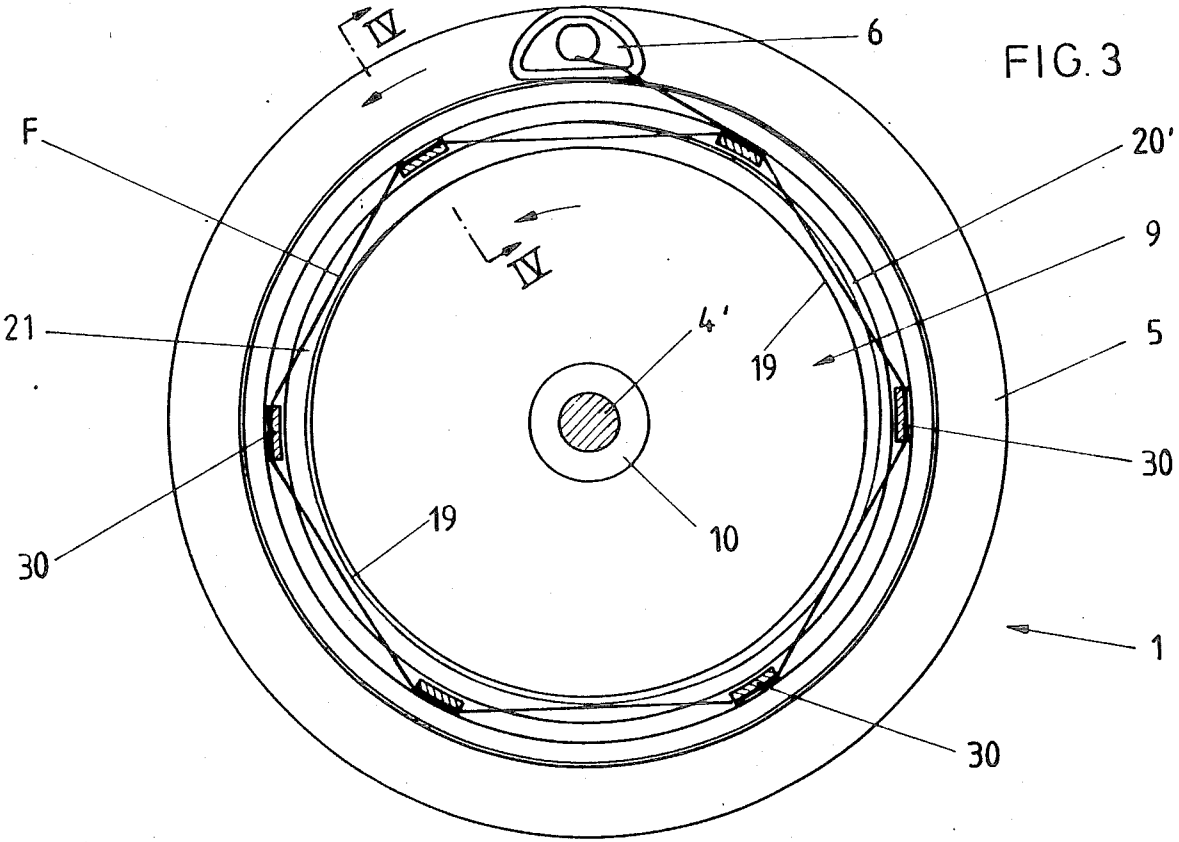
FIG. 3 is a cross-sectional view taken along line III—III of FIG. 2.
Figure 4:
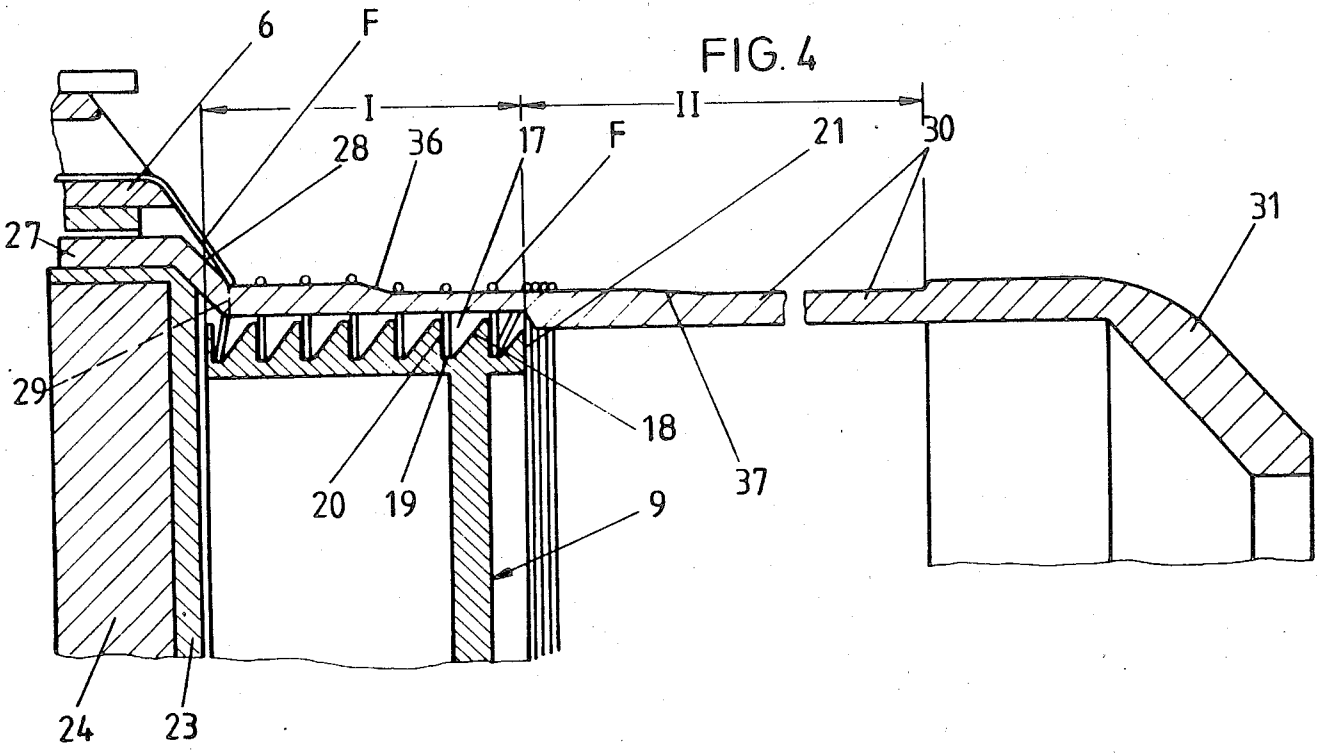
FIG. 4 is an enlarged sectional view taken along line IV—IV of FIG. 3.

Thread F is withdrawn from a supply reel (not shown) and enters the bore 8 in the motor shaft 4 and proceeds from there through the radial channel 7 to the thread eyelet 6 in the disc 5. From there, the thread F runs across the truncated cone-sliding surface 29 into the start of the thread-receiving groove 17, in a way such that the front face section 20'' located at the thread entrance point A will not interfere with the entrance of the thread F. The thread eyelet 6 plus rotary body 9 rotate in the rotary direction illustrated in FIG. 3. Due to the left-hand threading of the groove 17, the individual thread windings are laid on the section I. Extending between the polygon bars 30, the thrust faces 20' of the front faces 20 of the threading groove 17 cause a trouble-free advance of the thread loops. Once the section I is filled, the thread windings are advanced on the succeeding section II by the last front face 21 of the rotary body 9 which serves as a thrust surface. The thread on section 10 is advanced with the windings looped closely together into the area of the photoelectric relay 35 which senses the endmost loop and shuts the drive of the motor shaft 4 off. The thread withdrawal takes place by way of the withdrawal cup 31 and the withdrawal eyelet 34. As the thread supply diminishes, the photoelectric relay 35 reactivates the drive for replenishment of the looped supply.

From the foregoing disclosure of the general principles of the present invention and the above description of the preferred embodiment, those skilled in the art will readily comprehend various modifications to which the invention is susceptible. Therefore, I desire to be limited only by the scope of the following claims.

Having described my invention, I claim:

1. A thread-delivery device comprising:

a storage body, said storage body including first and second sections, said sections being in axial alignment with one another;

said first section comprising a plurality of bars extending axially and defining a polygon for receiving loops of thread wound about said polygon;

a member configurated to form peripheral threading grooves intermediate said bars, said grooves including a bottom portion, said bottom portion being located radially inwardly of said bars, whereby said grooves are adapted to receive thread wound about said bars, said grooves having a front face for advancing the thread toward said second section;

extensions formed on said bars, said extensions constituting said second section of said storage body, said extensions forming a polygon, said thread being wound about said extensions and being removable from said second section, the circumferential length of the first section polygon being substantially equal to the circumferential length of the second section polygon.

2. The thread-delivery device of claim 1 in which said threading grooves include a face extending toward said second section and outwardly at an incline.

3. The thread-delivery device of claim 1 in which said threading grooves have a sawtooth shape in longitudinal section.

4. The thread-delivery device of claim 1 in which said member is cylindrical, and said threading grooves form a continuous helix on the cylindrical surface of said cylindrical member, and means for rotating said member.

5. The thread-delivery device of claim 4 further comprising a step formed on the outer portion of said bars adjacent to the midpoint of the length of said cylindrical member.

6. The thread-delivery device of claim 1 further comprising a ring, said bars being connected to said ring, means forming a feed opening for thread adjacent to said ring, said ring having a conic surface in the plane of said feed opening and a front ring face, said groove adjacent said ring having a front face section disposed in the same plane as said front ring face.

7. The thread-delivery device of claim 1 further comprising a sensing device for sensing the endwise thread winding on said second section remote from said first section for controlling thread feed.

* * * * *